US006146232A

United States Patent [19]

Robbins

[11] Patent Number: 6,146,232

[45] Date of Patent: Nov. 14, 2000

[54] TOY LOGS HAVING NOVEL SHAPE

[76] Inventor: William D. Robbins, 7 Knoll Tavern Rd., Flemington, N.J. 08822

[21] Appl. No.: 09/406,160

[22] Filed: Sep. 27, 1999

[51] Int. Cl.[7] ..... A63H 33/08

[52] U.S. Cl. ..... 446/106; 55/233

[58] Field of Search ..... 446/106, 85, 105, 446/108, 114, 115, 117, 124; 55/233

[56] References Cited

U.S. PATENT DOCUMENTS

| | | | |
|---|---|---|---|
| 1,936,571 | 11/1933 | Bumann . | |
| 2,059,598 | 11/1936 | Paulson . | |
| 3,257,762 | 6/1966 | Steiner | 446/106 |
| 4,429,500 | 2/1984 | Farmont | 446/106 |
| 5,145,440 | 9/1992 | Boris et al. | 446/106 |
| 5,846,114 | 12/1998 | Frandsen, II | 446/106 |

*Primary Examiner*—Sam Rimell
*Attorney, Agent, or Firm*—Volpe and Koenig, P.C.

[57] ABSTRACT

A substantially cylindrical-shaped log having two planar surfaces substantially perpendicular to each other formed on the surface of the log with the remaining surface being generally cylindrical to provide structural support which is superior to that of a building log unit with only a cylindrical surface. The building log provides the child an option of interior and exterior play surfaces and further selectively provides a traditional exterior of round logs as well as a more modern exterior of a substantially planar facade, as well as providing a log structure which has excellent stability and structural strength when used as a base log, as well as a log placed in a intermediate position in a structure.

9 Claims, 2 Drawing Sheets

TOY LOGS HAVING NOVEL SHAPE

FIELD OF THE INVENTION

The present invention relates to building log units adapted to be easily assembled into structures without the use of an adhesive or other fastening devices and thereafter to be easily disassembled by children. Examples of structures which may be fabricated by these building log units include toy houses, bird cages, stockades and structures which have similar shapes or which serve similar functions.

BACKGROUND OF THE INVENTION

For more than four decades, children have played with toy miniature building sets, for example a building set known as Lincoln Logs, where miniature, log-simulating units with notched grooves are mated with one another to build structurally sound toy houses, stockades, bird houses and other small structures. As the small, generally cylindrical Lincoln Logs are held in position relative to each other by the coaction of grooves at the ends of each log, the structure built by the child can be readily assembled and disassembled without the use of adhesives or other fastening devices. Such toy building sets have served their function well and provided many hours of pleasant and rewarding activities for children.

U.S. Pat. No. 5,846,114 discloses a building unit for constructing a structure, the unit being in the shape of a generally cylindrical log formed by a light-weight, resilient core encased snugly in a fabric covering having the same shape as the core. The invention discloses the use of the above units to build an interconnecting structure which can house children or adults and which be used for many purposes other than a toy house.

U.S. Pat. No. 5,145,440 is directed toward a toy house that is of a size that can actually be occupied by a child. In this invention, the play structure is constructed of inflatable elements that are deflated when not in use and stored in a relatively deflated condition.

U.S. Pat. No. 3,257,762 is directed to the same basic structure as the Lincoln Log play house but which may actually be used as such for construction of more structurally stable buildings by adults. Each building unit of each structure is inwardly tapered in width at the top and bottom thereof to facilitate assembly of the joints. The shape and configuration of the notches and recesses distinguish this invention from other building units. The building unit, according to the invention, when driven together to form an interlocking joint, are impacted together to an extent where the area of impact is considerably greater than that occurring in prior art joints.

U.S. Pat. No. 2,059,588 discloses building units comprising simulated log members substantially square in cross-section with notches in their faces adapted to interfit when the logs are arranged in cross relationship so as to permit the body of each log in each wall portion to have flat face arrangement with the body of an adjacent log in the same wall portion. Short simulated log members comprise rectangular cross-section members having notches in substantially centered positions longitudinally and adapted to have interfitting engagement with the ends of the first mentioned logs at a wall opening such as a doorway.

U.S. Pat. No. 1,936,571 discloses a simulated log structure specifically for building a toy house that may be used as a bird house. The toy house comprises a base floor, walls on the base floor formed by a series of elongated wall units and keying units between the wall units, a roof covering the walls, fastening rods carried by the base floor and extending upwardly through the walls at the corners of the house, and a nut threaded upon the upper end of each rod for clamping the roof and wall elements in assembled relation upon the base floor. The wall units or building blocks provide log simulating units and preferably have their outer surfaces rounded, and have flat upper and lower and inner faces.

While the prior art recognizes the use of generally cylindrical logs, the present invention is directed to a substantially cylindrical-shaped log which has two planar surfaces substantially perpendicular to each other formed on the surface of the log with the remaining surface being generally cylindrical to provide structural support which is superior to that of a building log unit with only a cylindrical surface. It is also another object of the invention to provide a building log unit which provides the child an option of the interior and exterior play surface and which further selectively provides a traditional exterior of round logs as well as a more modern exterior of a substantially planar surface, as well as providing a log structure which has excellent stability and structural strength when used as a base log, as well as a log placed in a intermediate position in a structure.

BRIEF DESCRIPTION OF THE INVENTION

The present invention takes the form of building units for constructing a finished structure such as a house, stockade or other similar structure that are formed from logs having notched ends. A building unit according to the present invention comprises a generally elongated, substantially cylindrical log on which two planar surfaces, perpendicular to each other, are formed on portions of the log surface adjacent to one another. Planar surfaces may be also be formed on diametrically opposite surfaces of the log, or alternatively also on two additional surfaces of the elongated cylindrical structure.

If the generically cylindrical log has one or more surfaces which are planar or flat, the child is given a choice of whether to use a cylindrical of planar surface for the interior or exterior surface of the structure constructed. Furthermore, the flat surface of a log may be used as a base member to provide excellent structural support for the structure constructed, as compared to the support provided by a base member which is generally cylindrical in shape, as well as eliminating the need for a half log as the base member.

OBJECTS OF THE INVENTION

Lincoln logs and similar building units are generally fabricated in the shape of cylindrical shaped logs. The structure fabricated by the use of these logs has the same feel and appearance on both the inner and outer surface of the structure. Also, due to the cylindrical, shape of the members, the structural support provided by the base member is not as firm as the support provided by a member with two flat surfaces, and Requires a split or half log having a half-cylinder cross-section to provide a base log. Such split logs cannot be used in an intermediate location in a structure.

It is therefore one object of the invention to provide a novel building log unit with two planar surfaces perpendicular to each other with the remaining surfaces being generally cylindrical, and adapted to be assembled into structures without the use of separate fastening devices or an adhesive and thereafter to be easily disassembled by children, to provide stable structures having different exterior appearances selected by the user.

Another object of the present invention is to provide a building log unit which provides better structural support to the structure fabricated by the use of members which have two planar surfaces with the remaining surface being generally cylindrical.

DETAILED DESCRIPTION OF THE INVENTION AND PREFERRED EMBODIMENTS THEREOF

Figure 1:
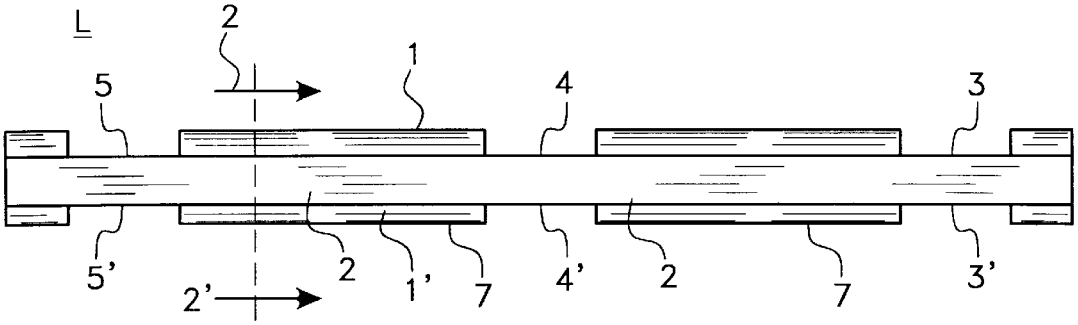
FIG. 1 is a side view of the building log unit of the present invention showing the generally cylindrical surface 1, the planar surfaces 2 and 7 extending to the cylindrical surface 1 and notched grooves 3, 4 and 5.

FIG. 1 shows a sectional view of a building log unit L embodying the principles of the present invention and which, generally speaking, resembles a conventional toy building log, and preferably being of a color (brown) to further more closely resemble a conventional toy building log. Log L is comprised of cylindrical surface 1. A lower planar surface 7 is diametrically opposed to cylindrical surface 1 and is provided with substantially square-shaped notches 3,4 and 5 formed at spaced intervals along the length of log L. In use, the building log units are positioned in a criss-cross fashion so that a notch in an upper log mates with a similar shaped notch in a lower log supporting the upper log. A plurality of such logs may be positioned in interlocked fashion to form a building or structure such as a toy house, i.e., a log cabin, lean-to, general store, stockade and the like.

Figure 2:
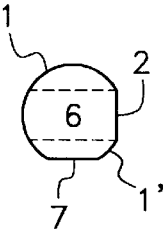
FIG. 2 is an end sectional view of the building log unit of FIG. 1 showing planar surfaces 2 and 7 and the generically cylindrical surface 1.

FIG. 2 is a sectional view of log L in FIG. 1 looking in the direction of arrows 2—2 of FIG. 1. FIG. 2 shows the horizontal planar surface 7 at the base of the building unit, which surface 7 supports the structure. Adjacent planar surface 2 is perpendicular to planar surface 7. The right-hand end of surface 7 merges with a cylindrical-shaped surface 1 positioned between planar surfaces 7 and 2. The left-hand end of planar surface 7 merges with cylindrical-shaped surface 1 and the upper end of planar surface 2 merges with cylindrical-shaped surface 1.

Figure 3:
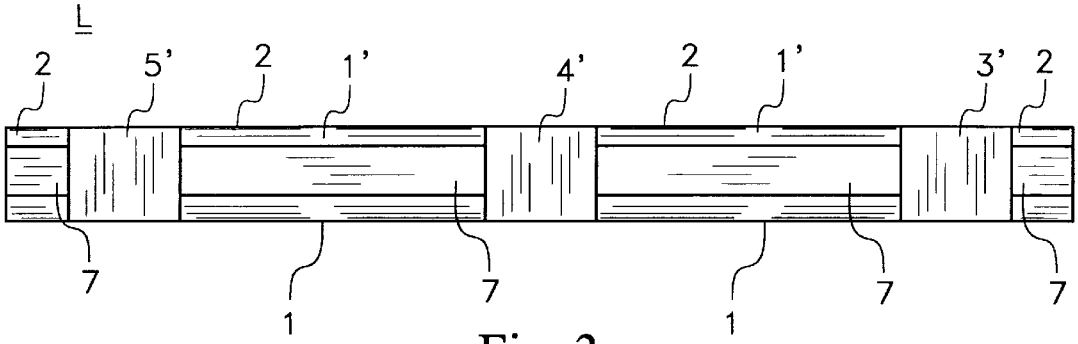
FIG. 3 is a plan view of the building log unit showing the planar surface 2 and 7 and notched grooves 3, 4 and 5.

FIG. 3 is a top plan view of the building log L showing planar surface 7, a portion of the cylindrical surface 1 above planar surface 7 and cylindrical surface 1 below surface 7 and planar surface 2 at the bottom of FIG. 3. Notches 3, 4 and 5 are shown formed at spaced intervals along the length of the log.

Figure 4A:
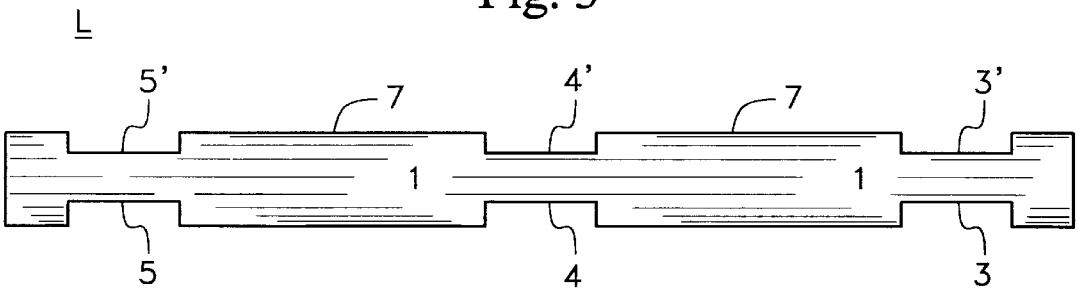
FIGS. 4*a* and 4*b* are views of the log looking on opposite sides of the view shown in FIG. 3.
Figure 4B:
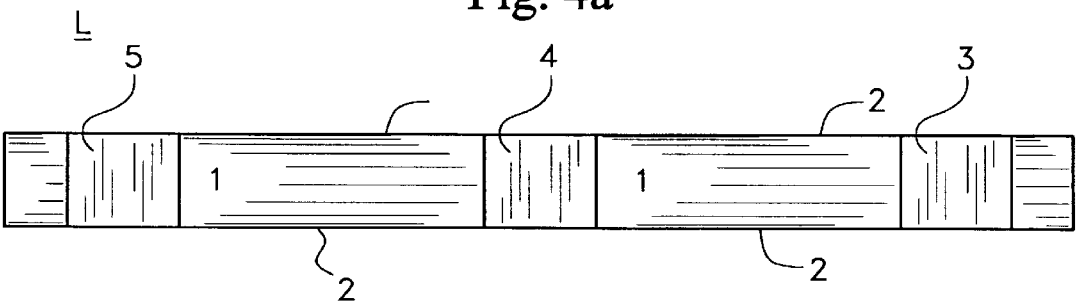

FIG. 4*a* is a plan view of the building unit with planar surface 2 out of sight and with cylindrical-shaped surface principally in view. Notches 3, 4 and 5 and notches 3', 4' and 5' respectively arranged diametrically opposite one another are provided to interlock with log arranged above and below log L shown in FIG. 4*a*. FIG. 4*b* shows a view of the log L looking on the opposite side of FIG. 3 than that of FIG. 4*a*.

Figure 5:
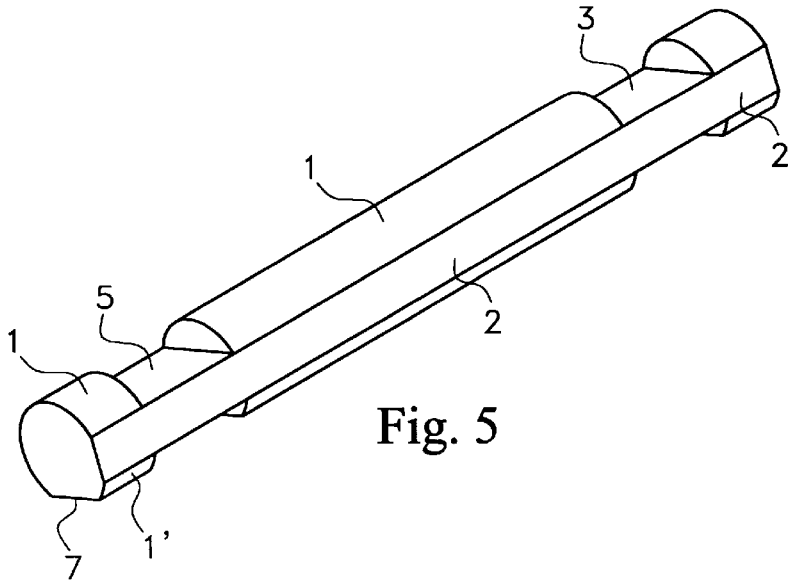
FIG. 5 is an isometric view of the building log unit.

FIG. 5 is an isometric view of a building log L□ similar to log L and showing cylindrical surface 1 and only two (2) pairs of notches 3, 5 and 3',5' respectively arranged to be diametrically opposed. The log L' may be either longer or shorter than log L, for example. Also, the log may have as few as only a single pair of diametrically opposed notches, such as the short log shown in FIG. 6 of Paulson U.S. Pat. No. 2,059,598, which is incorporated herein by reference thereto.

Figure 6:
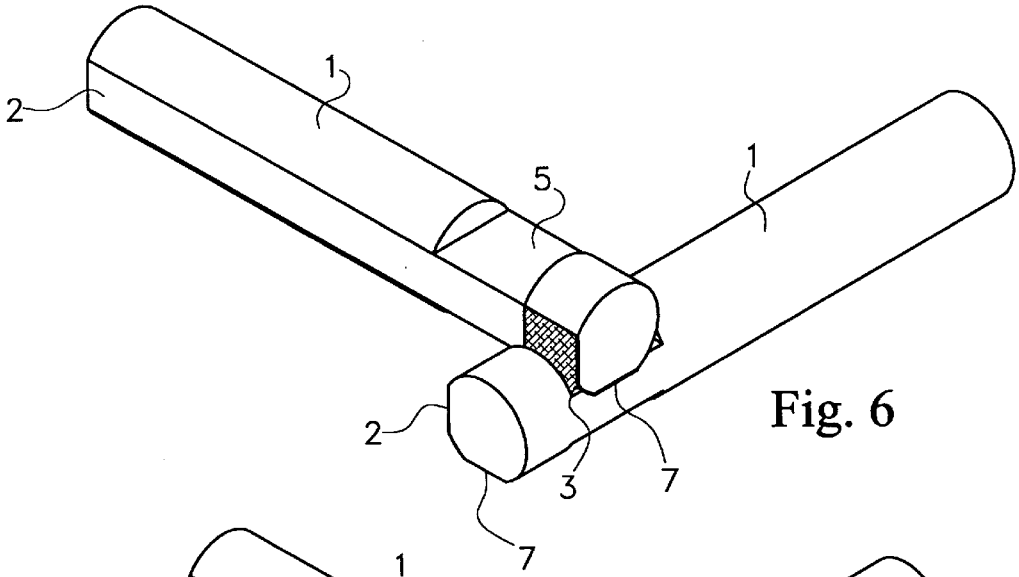
FIG. 6 is an isometric of two building log units mated with each other with the planar surface 2 of the lower building log unit at the base of the building log units placed above.

FIG. 6 is an isometric view showing two building logs arranged in criss-cross fashion and which are held interlocked to each other by the coaction of groove 3 in the lower log with an end portion of the upper log arranged in the notch 3 so that the planar surface 2 rests upon notch 3. The notches 3, 4 and 5 have a width which can accommodate the width measured across the planar surface 7 and the diametrically opposed portion of cylindrical surface 1. FIG. 6 shows the two building units with their planar surfaces 2 facing downwardly. Both the upper and lower logs have their planar surfaces facing downwardly and portions of the cylindrical surface 1 facing upwardly, the remaining portions of the cylindrical surfaces facing outwardly (for the lower log) and to the right (for the upper log).

Figure 7:
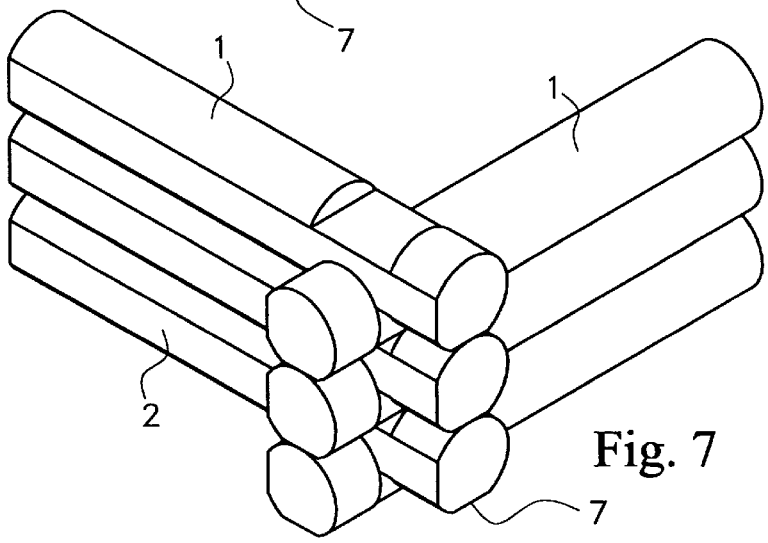
FIG. 7 is an isometric view of several building log units mated with each other as they would if a structure is to be formed from them with the planar surface 2 of the lower building log unit at the base of the building log units.

FIG. 7 is an isometric view of a plurality of building logs arranged in criss-cross fashion and held together in position relative to one another by the coaction of the notches provided on each log. It should be noted that the traditional "rounded" facade may be provided by aligning the logs L as shown or, alternatively that a flat or planar facade may be provided as shown by the arrangement of the logs L.

The invention comprises a plurality of log-simulating units which have two flat surfaces and a contiguous cylindrical surface with notches provided at intervals along the length of each log. The building units are held in place by the coaction of the notches which are positioned to interfit with similarly shaped logs.

In a preferred form of the embodiment, the building unit is in the general form of an elongated, substantially cylindrical log with two planar surfaces perpendicular to each other formed on the cylindrical surface. The generally cylindrical log has at least two pairs of diametrically-opposed notches at opposite ends of the log and, in some cases have centrally located, diametrically-opposed notches. These notches are shaped to mate with similarly shaped notches in mating logs, so that, when arranged in interlocking relationship, the logs are self-locking and will be retained in their interlocked positions. The logs may also be used as base members, due to their inherent stability when a planar surface is arranged to face downwardly. The unique configurations and dimension of the notches and the width of a log measured along a diameter perpendicular to one of the planar surfaces, permits a portion of a log, other than a notch, to be received within the notch of another log.

In the preferred form of the invention, the log is generally cylindrical and has two adjacent surfaces that are planar and are perpendicular to each other such that when two logs are interfitted, the opposed planar surfaces will meet and form a contiguous surface, the junction of which provides a seal between logs that will be more rigid and structurally stable than traditional logs which make only line contact with each other, which is the case when the logs are cylindrical.

The inherent instability associated with cylindrical Lincoln log type structures where a cylindrical surface is used as the base member is also overcome by the use of the log of the present invention as a base member which has a flat surface as shown in FIGS. 6 and 7. Flat surfaces of adjacent building units may also be positioned to provide structural stability to the structure constructed.

The building units may be constructed with one or more flat adjacent or non-adjacent surfaces, with the remaining surface of the log being of a generally cylindrical configuration. In the preferred embodiment of the invention, the building unit comprises two flat surfaces with the remaining surface being generally cylindrical in shape.

Since the appearance of the logs is cylindrical in part of the surface and flat at one or more sections of the surface, the user constructing the structure has a choice of having the interior surface or the exterior surface of the building constructed appear flat or cylindrical or have a hybrid flat-cylindrical appearance as shown in FIGS. 6 and 7.

The building units may be constructed of a suitable material which may occur naturally such as wood or fiberboard, or it may comprise a synthetic material such as hard or soft (and light or heavy) plastic, rubber foam, polyurethane, etc.

When the user desires to employ the building unit to construct a different type of structure, the structure may be disassembled without any harm to any children in close proximity to the playhouse as the materials from which the toy house are constructed are preferably light-weight and resilient.

However, it is considered to be within the broad scope of the present invention that these building units can also be put to more permanent use, for example, by erecting a building, the matching notches of which will be sealed together, for example, by cement or adhesive, or other suitable fastening means, so that a more or less permanent structure is formed. Thus, while perhaps, at this time the primary use of the present invention will be as a toy for children, its uses are certainly not limited to a toy.

It can thus be seen that the present invention provides a unique and yet simple and inexpensive apparatus and method for building structures with improved structural stability and improved internal and external visual appearance. A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention described herein.

What is claimed is:

1. A building log unit, a plurality of which may be used to form a structure, the building log unit comprising:

a generally elongated, substantially cylindrical-shaped member shaped to resemble a log, said log having first and second planar surfaces arranged perpendicular to one another, a diagonally aligned surface positioned between adjacent longitudinal edges of said planar surfaces; a cylindrical surface extending between remaining longitudinal edges of said planar surfaces; and said log unit having a first set of notches provided near opposite ends thereof, said notches being shaped to interlock with similarly shaped notches formed in other similarly shaped logs.

2. A building unit as claimed in claim 1 wherein one of the first planar surfaces forms a base member of a structure built so as to provide increased structural stability to the structure fabricated from the log units.

3. A building unit as claimed in claim 1 wherein the log unit is provided with a second set of notches arranged diametrically opposed to the first set of notches.

4. A building unit as claimed in claim 1 wherein said first set of notches are square-shaped.

5. A building unit as claimed in claim 1 wherein said first set of notches are provided in one of said planar surfaces.

6. A building unit as claimed in claim 1 wherein said first set of notches are provided in said cylindrical surface, diametrically opposed to one of the planar surfaces.

7. A building unit as claimed in claim 1 wherein said first set of notches provided in one of said planar surfaces have a width which is substantially equal to a width of the log measured along a diameter which is perpendicular to one of said planar surfaces.

8. A building log unit, a plurality of which may be used to form a structure, the building log unit comprising:

a generally elongated, substantially cylindrical-shaped member shaped to resemble a log, said log having first and second planar surfaces arranged perpendicular to one another, a diagonally aligned surface positioned between adjacent longitudinal edges of a planar surfaces; said cylindrical surface extending between the remaining longitudinal edges of said planar surfaces;

said log having at least a pair of diametrically opposed of notches, said notches being shaped to interlock with similarly shaped notches formed in other similarly shaped logs.

9. A building unit as claimed in claim 1 wherein said diagonally aligned surface is a curved surface having a radius of curvature substantially the same as said cylindrical surface.

* * * * *